United States Patent [19]

Simonsson

[11] 4,351,083

[45] Sep. 28, 1982

[54] VACUUM CLEANING NOZZLE

[75] Inventor: Sven B. Simonsson, Tyreso, Sweden

[73] Assignee: Aktiebolaget Electrolux, Stockholm, Sweden

[21] Appl. No.: 201,525

[22] Filed: Oct. 28, 1980

Related U.S. Application Data

[63] Continuation-in-part of Ser. No. 11,414, Feb. 12, 1979, abandoned.

[30] Foreign Application Priority Data

Feb. 15, 1978 [SE] Sweden ..... 7801751

[51] Int. Cl.[3] ..... A47L 9/06

[52] U.S. Cl. ..... 15/373

[58] Field of Search ..... 15/360, 365, 367, 373

[56] References Cited

U.S. PATENT DOCUMENTS

| | | | |
|---|---|---|---|
| 3,040,364 | 6/1962 | Carlberg | 15/373 X |
| 3,040,368 | 6/1962 | Nilsson | 15/373 |
| 3,727,263 | 4/1973 | Johansson | 15/373 |
| 3,952,363 | 4/1976 | Lindmann | 15/373 |

*Primary Examiner*—Chris K. Moore

*Attorney, Agent, or Firm*—Alfred E. Miller

[57] ABSTRACT

A nozzle for a vacuum cleaning apparatus having two movable working members, that is a brush nozzle and flat surface nozzle which can be alternately brought into contact with a working surface, such as a floor, by means of an actuating member operating between two end positions. A blocking means is arranged to block the actuating member in either of the end positions. The flat surface nozzle is arranged to be lowered to a position on the working surface in which the flat surface nozzle is located below the front edge of the brush nozzle in order to pick up dust and dirt near vertical surfaces.

8 Claims, 7 Drawing Figures

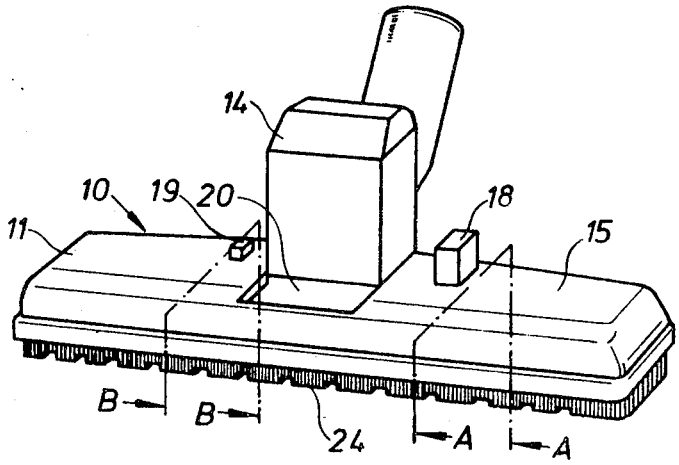
Fig.1
Fig. 2
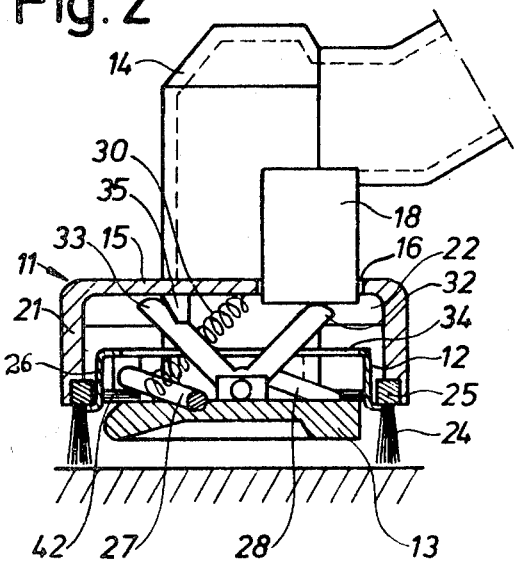
Fig.4
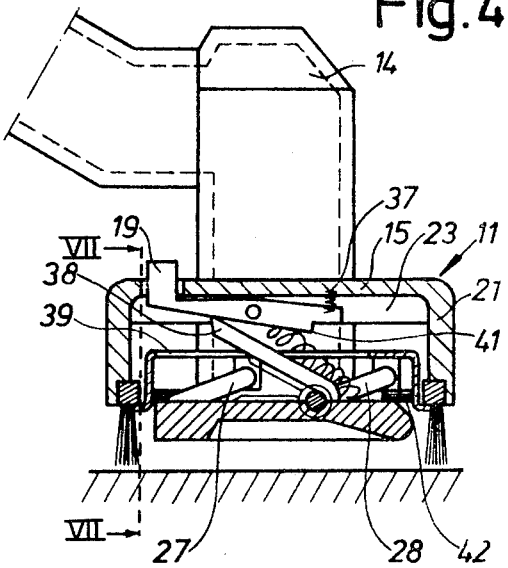
Fig.3
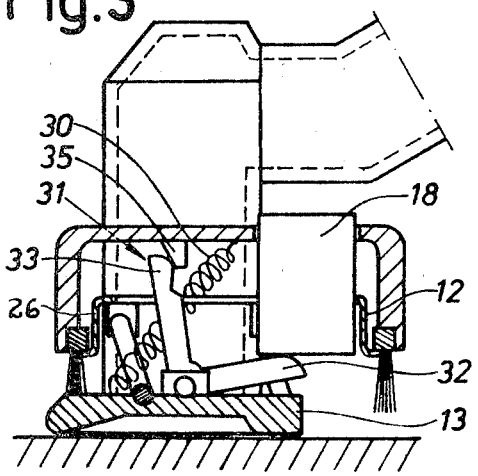
Fig.5
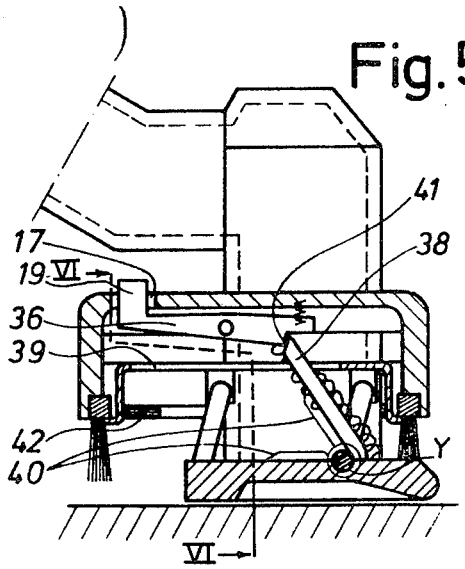

Fig. 6
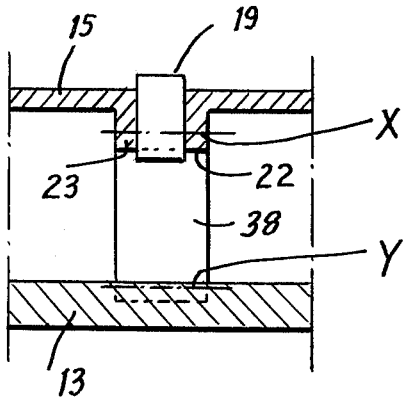
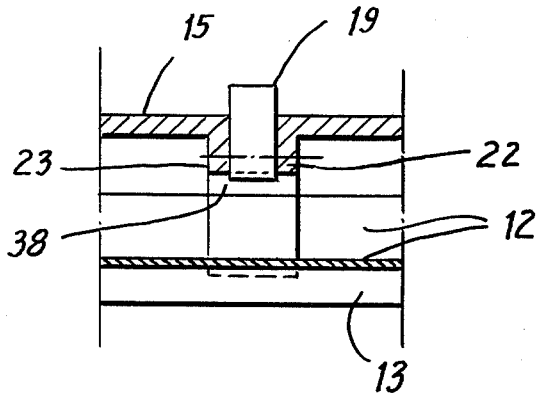
Fig. 7

VACUUM CLEANING NOZZLE

The present application is a continuation-in-part of Ser. No. 11,414, filed Feb. 12, 1979 and now abandoned.

Vacuum cleaners are known to have a flat surface nozzle which incorporates a brush that can be lowered to a flooring position.

Known nozzles of this kind are arranged in such a way that with the flat surface nozzle in its lower working position it is difficult to pick up dust and dirt near vertical surfaces, because the suction opening does not extend all the way to the front edge of the nozzle housing. As a result a narrow strip of the working area near vertical surfaces, such as walls and furniture remain uncleaned since they cannot be reached by the suction opening of the flat surface nozzle.

A principal feature of the present invention is to eliminate this drawback and the invention is mainly characterized in that the flat surface nozzle from its non-working position inside the brush nozzle is movable to a working position in which position the front edge of the flat surface nozzle is below and essentially in line with or in front of the front edge of the brush nozzle, as seen in the working direction of the vacuum cleaner nozzle.

In order that the invention will be more clearly understood, it will now be disclosed in greater detail with reference to the accompanying drawings, in which:

FIG. 1 is a perspective view of a vacuum cleaner nozzle constructed according to the teachings of the present invention;

FIG. 2 is a section through the nozzle shown in FIG. 1 along lines A—A with the flat surface nozzle in a non-working position;

FIG. 3 is a section taken through the lines A—A of the nozzle shown in FIG. 1, but with the flat surface nozzle in a working position;

FIG. 4 is a section taken through the lines B—B of FIG. 1 with the flat surface nozzle in a non-working position;

FIG. 5 is a section taken along the lines B—B of FIG. 1 with the flat surface nozzle in a working position;

FIG. 6 is a section taken along the lines VI—VI of FIG. 5; and

FIG. 7 is a section taken along the lines VII—VII of FIG. 4.

The entire nozzle is referred to generally by the reference numeral 10 and has a casing 11, a brush nozzle 12 and a flat surface nozzle 13. The casing is rotatably attached to a coupling member in the shape of a tube member 14 for conducting the dust laden air to a hose, (not shown) and further to a motor-fan unit (not shown). The upper portion 15 of the casing 11 is provided with two holes 16 and 17 through which holes an actuating member 18, and a blocking member 19 are accessible from the outside of the upper side of the nozzle.

The lower position of the tube member 14 is connected with the flat surface nozzle and extends through the upper part 15 of the casing 11 through a substantially rectangular opening 20 in which opening the tube member 14 is movable to a certain degree in a manner to be described hereinafter. The casing is further provided with vertical wall portions 21, thus giving the casing a box-like configuration.

The beams 22 and 23 extend across the nozzle 10 on the inner side of the part 15 and are connected to the casing 11. The brush nozzle 12 is rigidly attached to these beams. Furthermore, the brush nozzle comprises a brush bristle strip 24 extending around the nozzle inside its side walls 21 and held together by a ring 25. This ring is held tight between flanges 26 arranged in the plate and the wall portions 21, said flanges retaining the brush strip 24 in the brush nozzle. When worn out, the brush strip 24 together with the ring 25 can be quickly replaced by loosening the same from the flanges to remove the same, and thereafter a new brush strip can be inserted within the nozzle.

In the present embodiment the flat surface nozzle 13 is connected with the brush nozzle 12 by means of two link arms 27 and 28. The link arms 27 and 28 extend in the longitudinal direction of the flat surface nozzle and are essentially U-shaped. The bottom portion of the U-profile is swingably mounted in the flat surface nozzle 13 and its legs have portions which are parallel to the bottom portion and are swingable in shoulders 29 located on the under side of the brush nozzle 12. In addition, the flat surface nozzle 13 is connected to the brush nozzle through at least one tension spring 30 which biases the flat surface nozzle in its upper position inside the brush nozzle.

A V-shaped member 31 is pivotally mounted on the flat surface nozzle 13, said member protruding through an opening 34 in the brush nozzle 12 and having two firm legs 32 and 33 in relation to each other. The leg 32 is worked upon by the actuating member 18 protruding through the hole 16 in the casing 11. The free end of the leg 33 cooperates with a supporting shoulder 35, shaped on the under side of the casing 11. The blocking member 19 takes the form of a lever 36, which is swingably mounted in an elevation arranged on the under side of the casing 11. The lever 36 is actuated upon by the blocking member 19 protruding through the opening 17 in the casing 11 against the force of a spring 37 mounted on the opposite end of the lever 36. A tongue 38, pivotally mounted in the flat surface nozzle, cooperates with the lever 36, said tongue protruding through an opening 39 in the brush nozzle 12. A compression spring 40 maintains the tongue 38 away from the flat surface nozzle 13. The tongue cooperates with an elevation 41, adapted on the other side of the lever 36 for blocking the flat surface nozzle in its lower position.

The present vacuum cleaner nozzle device works in the following manner: For moving of the flat surface nozzle 13 from the non-working position shown in FIG. 2 to the working position, the actuating member 18 is pressed downwards. Via the V-shaped member 31, pivotally mounted on the flat surface nozzle 13, the force is transmitted to the flat surface nozzle 13 and with the supporting shoulder 35 as the approximate center of the pivotal motion of the flat surface nozzle. The latter describes an arc-shaped travel path, until it reaches the position shown in FIG. 3, which is an operative position. During the described movement movement the tongue 38 is moved from the initial position shown in FIG. 4 to the end position shown in FIG. 5, and its free end with the aid of the elevation 41 locks the flat surface nozzle 13 in its outward position. When returning the flat surface nozzle 13 to its non-working position, the blocking member 19 is pressed downwardly, and the coupling between the elevation 41 and the tongue upper edge is disengaged, and the flat surface nozzle is moved by the spring 30 back to its non-working position. A seal 42 is arranged on the inside of the brush nozzle 12 for preventing air from leaking into the opening 20, when the flat surface nozzle 13 is in its upper position.

The invention is not intended to be limited to the embodiment described and shown in the accompanying drawings, but several modifications are possible within the scope of the following claims.

What is claimed is:

1. A vacuum cleaner nozzle provided with a housing adapted to be connected to a source of suction comprising two working members constituting a brush nozzle and a flat surface nozzle, each of said nozzles being connected to said suction source, means mounting said brush nozzle and flat surface nozzle in said housing, a movable member mounted on the upper surface of said flat surface nozzle, two openings through a surface of said housing, an actuating member operable externally of said vacuum cleaner nozzle housing through one of said openings which when depressed engages said movable member on said flat surface nozzle to thereby move said flat surface nozzle into contact with a working surface in which the plane of the front edge of said flat surface nozzle is below the plane of the front edge of said brush nozzle, as viewed in the working direction, said actuating member moving said flat surface nozzle from a non-working condition to a working condition when said actuating member is depressed, a blocking means positioned through said other opening and having an elongated lever part extending within said housing adjacent to the top thereof and having a free end with a notch therein, said blocking means when operative locking said flat surface nozzle into contact with said working surface, a first spring mounted at one end at the free end of said lever part and at the other end on the undersurface of the top of said vacuum cleaner nozzle housing, said brush nozzle being provided with a relatively large opening, a spring-loaded elongated tongue pivotally mounted on one end on said flat surface nozzle and being biased away from said flat surface nozzle and passing through said relatively large opening while the free end thereof engages the notch in said lever part when said flat surface nozzle is moved into contact with said working surface, a second spring mounted at one end of said flat surface nozzle and at the other end on the undersurface of said top of the vacuum cleaner nozzle housing to bias said flat surface nozzle in an upper position in said brush nozzle, and said blocking means being depressed to thereby disengage the free end of said tongue from the notch on said lever part in order to return the flat surface nozzle to its non-working position by pivoting said tongue under spring force to effect said disengagement, and said flat surface nozzle is moved by said second spring to its non-working position.

2. A vacuum cleaner nozzle as claimed in claim 1 further comprising at least one link arm for connecting said flat surface nozzle to said brush nozzle.

3. A vacuum cleaner nozzle as claimed in claim 2 wherein said link arm extends in a longitudinal direction relative to said flat surface nozzle and is substantially U-shaped.

4. A vacuum cleaner nozzle as claimed in claim 3 wherein said U-shaped link arm is provided with a pair of legs and a connecting bight that is pivotally attached to said flat surface nozzle, and the legs thereof have portions that are parallel to said bight, said portions being pivotally mounted on said brush nozzle.

5. A vacuum cleaner nozzle as claimed in claim 3 further comprising a support shoulder on the underside of said top of the vacuum cleaner nozzle housing, said movable member comprising a V-shaped member being provided with two fixed legs, means pivotally mounting the junction section of said V-shaped member on the upper surface of said flat surface nozzle whereby upon pivotal movement of said member one of said legs assumes a substantially horizontal position while being engaged by said actuating member and the other of said legs assumes a substantially vertical position while engaging said support shoulder when said flat surface nozzle is in the working position.

6. A vacuum cleaner nozzle as claimed in claim 5 wherein said one fixed leg is capable of being depressed to cause the pivotal movement of said flat surface nozzle to its working position by means of said actuating member.

7. A vacuum cleaner nozzle as claimed in claim 2 wherein the movement of said flat surface nozzle between non-working and working positions describes an arc-shaped path.

8. A vacuum cleaner nozzle as claimed in claim 1 wherein said blocking means can be actuated from the outside of said nozzle against the force of said first spring.

* * * * *